US010458667B2

(12) United States Patent
Tran et al.

(10) Patent No.: US 10,458,667 B2
(45) Date of Patent: Oct. 29, 2019

(54) AIR VENTILATION SYSTEM

(71) Applicants: Hai Thanh Tran, West Covina, CA (US); Andre Alfonso Tran, West Covina, CA (US); Jennifer Patricia Tran, West Covina, CA (US); Patricia Gabriel Tran, La Puente, CA (US); Martha Patricia Villalobos, La Puente, CA (US)

(72) Inventors: Hai Thanh Tran, West Covina, CA (US); Andre Alfonso Tran, West Covina, CA (US); Jennifer Patricia Tran, West Covina, CA (US); Patricia Gabriel Tran, La Puente, CA (US); Martha Patricia Villalobos, La Puente, CA (US)

( * ) Notice: Subject to any disclaimer, the term of this patent is extended or adjusted under 35 U.S.C. 154(b) by 766 days.

(21) Appl. No.: 14/957,977

(22) Filed: Dec. 3, 2015

(65) Prior Publication Data

US 2016/0091216 A1 Mar. 31, 2016

Related U.S. Application Data

(63) Continuation-in-part of application No. 14/486,626, filed on Sep. 15, 2014, now abandoned.
(Continued)

(51) Int. Cl.

| | |
|---|---|
| ***F24F 11/00*** | (2018.01) |
| ***F24F 13/14*** | (2006.01) |
| *F24F 13/20* | (2006.01) |

(52) U.S. Cl.
CPC ..... *F24F 11/0001* (2013.01); *F24F 13/1426* (2013.01); *F24F 2013/1433* (2013.01); *F24F 2013/207* (2013.01)

(58) Field of Classification Search
CPC ..... F24F 11/0001; F24F 13/1426
(Continued)

(56) References Cited

U.S. PATENT DOCUMENTS 1,787,623 A * 1/1931 Harnett ..... G05D 23/028 236/38
2,086,617 A * 7/1937 Hiner ..... F23L 13/00 137/505
(Continued)

FOREIGN PATENT DOCUMENTS

JP 59191822 A * 10/1984

*Primary Examiner* — Kenneth Rinehart
*Assistant Examiner* — Phillip Decker
(74) *Attorney, Agent, or Firm* — Hankin Patent Law, APC; Kevin Schraven; Anooj Patel

(57) ABSTRACT

An air ventilation system. The system may comprise an air flow control box and a control module, wherein the air flow control box may comprise: a damper housing, ventilation cap, damper assembly, control arms, and damper motor. The damper housing may define a passage traversing from a proximal end to a distal end of the damper housing and may comprise a ventilation opening. The ventilation cap may be hingedly connected to the damper housing for selective movement between an open position and a closed position. The damper assembly may be in covering relation with the passage and may comprise damper blades that pivot together for selective movement between an open position and a closed position. The damper motor may actuate the selective movement of the ventilation cap and the plurality of damper blades via the control arms. The control module may actuate the damper motor of the air flow control box.

13 Claims, 7 Drawing Sheets

Related U.S. Application Data

(60) Provisional application No. 61/880,831, filed on Sep. 20, 2013.

(58) Field of Classification Search
USPC ..... 454/256
See application file for complete search history.

(56) References Cited

U.S. PATENT DOCUMENTS 2,191,774 A * 2/1940 Reed ..... F24F 7/02 454/349
2,273,260 A * 2/1942 Guler ..... F24D 19/1006 236/38
2,400,044 A * 5/1946 Hermanson ..... F24F 13/1413 251/61
2,582,356 A * 1/1952 Rauhut ..... F24F 7/007 454/207
3,769,810 A * 11/1973 Swartwout ..... F24F 13/15 62/183
4,037,783 A * 7/1977 Bradford ..... F24F 11/0001 165/249
4,210,277 A * 7/1980 Kolt ..... F24F 11/76 236/49.5
4,591,092 A * 5/1986 Kolt ..... F24F 7/00 236/49.5
4,711,626 A * 12/1987 Hoyme ..... F23L 3/00 126/285 R
4,765,231 A * 8/1988 Aniello ..... F24F 7/08 454/239
4,776,385 A * 10/1988 Dean ..... F24D 5/04 165/248
4,777,932 A * 10/1988 Pennington ..... F24F 13/1426 110/163
5,044,402 A * 9/1991 Haas ..... F16K 1/16 137/625.44
5,609,522 A * 3/1997 Szwartz ..... F23L 13/02 110/162
7,191,607 B2 * 3/2007 Curtis ..... B60H 1/00785 62/186
7,918,407 B2 * 4/2011 Patch ..... F24F 11/0001 236/49.3
8,550,888 B2 * 10/2013 Hildreth, Jr. ..... F16K 1/165 251/212
8,790,451 B1 * 7/2014 Narayanamurthy ..... B01D 53/261 62/271
9,062,893 B2 * 6/2015 Romanowich ..... F24F 13/1426
9,933,182 B2 * 4/2018 Alfakhrany ..... F24F 11/0001
10,072,860 B2 * 9/2018 Richards ..... F24F 7/04
2002/0175305 A1 * 11/2002 McCabe ..... A62C 2/14 251/129.12
2005/0087614 A1 * 4/2005 Ruise ..... F24F 7/06 236/49.3
2006/0090745 A1 * 5/2006 Cormier ..... F23L 13/02 126/285 R
2010/0006659 A1 * 1/2010 Chun ..... F24F 11/0001 236/49.3
2010/0314569 A1 * 12/2010 Hildreth, Jr. ..... F16K 1/165 251/212
2011/0076934 A1 * 3/2011 Stenfors ..... F24F 12/006 454/239
2011/0259559 A1 * 10/2011 Gheyri ..... F24D 5/005 165/121
2011/0281516 A1 * 11/2011 Newcomer ..... F24F 3/044 454/231
2012/0148387 A1 * 6/2012 Labrecque ..... F04D 25/14 415/148
2012/0222851 A1 * 9/2012 Arinez ..... F24F 13/12 165/247
2012/0290136 A1 * 11/2012 Romanowich ..... F24F 13/1426 700/276
2014/0041846 A1 * 2/2014 Leen ..... G05D 23/1934 165/208
2015/0258488 A1 * 9/2015 Meirav ..... F24F 3/0442 95/115

* cited by examiner

AIR VENTILATION SYSTEM

CROSS-REFERENCE TO RELATED APPLICATIONS

This Application is a continuation-in-part of U.S. Non-Provisional patent application Ser. No. 14/486,626, filed on Sep. 15, 2014, titled "Superior Central Air Ventilation System", by co-inventors Hai Thanh Tran, Andre Tran, Jennifer Tran, Patricia Tran, and Martha Villalobos, the contents of which are expressly incorporated herein by this reference and to which priority is claimed. U.S. Non-Provisional patent application Ser. No. 14/486,626 also claims the benefit of U.S. Provisional Patent Application No. 61/880,831, filed on Sep. 20, 2013, titled "Superior Central Air Ventilation System", by co-inventors Hai Thanh Tran, Andre Tran, Jennifer Tran, Patricia Tran, and Martha Villalobos, the contents of which are expressly incorporated herein by this reference as though set forth in their entirety.

FIELD OF USE

The present disclosure relates generally to air ventilation systems, and more particularly, to air ventilation systems for recirculating furnace air for purposes of cooling a home or any building structure.

BACKGROUND

Various ventilation systems exist to provide cooling for building structures such as homes. The typical ventilation system generally replaces the interior air in a particular and defined space to provide high indoor air quality. This may be accomplished by controlling the temperature, replenishing oxygen, and/or removing moisture, odors, smoke, heat, dust, airborne bacteria and carbon dioxide. These ventilation systems are also generally used to remove unpleasant smells and excessive moisture, introduce outside air, maintain air circulation within an interior of a building, and prevent stagnation of the interior air.

In general, ventilation systems vary in design and may be as simple as a single, standalone air conditioner to a complex heating, ventilating, and air conditioning (HVAC) system to a whole house fan ventilation system. An air conditioning window unit, for example, may be installed in an opening, such as a window, of a building. The air conditioner window unit usually includes a fan that blows the interior air over the evaporator and generally includes a second fan for drawing heat from the interior out to the environment. Several of these window air conditioner units may be added to each room of a home to provide cooling for each separate room.

Ventilation systems may also include complex HVAC systems such as central air conditioning units, which are generally used to offer whole-house or large-commercial-space cooling. Central air conditioning also typically offers moderate multi-zone temperature control capabilities, as they allow cool air to circulate through a system of supply and return ducts. The supply ducts (i.e., openings in the walls, floors, or ceilings covered by grills) preferably carry cooled air from the air conditioner to the home. This cooled air becomes warmer as it circulates through the home and then preferably flows back to the central air conditioner through return ducts and registers.

Unfortunately, much of these ventilation systems generally expend a significant amount of energy. For instance, in a typical home or dwelling, air conditioning typically utilizes more electricity than any other appliance in the home and may expend as much as 16% of the total electricity used in that home. This is especially noticeable in warmer regions, as the use of air conditioners may comprise 60-70% of a homeowner's electricity bill.

Additionally, adding a new ventilation system such as a cooling unit to a home may require that the homeowner create physical modifications to his or her home. For instance, some indoor cooling units generally require that the homeowner install one or more mounting plates for holding and securing the cooling unit. The mounting plate is fastened against the wall via screws, and the cooling unit is attached to the wall via the mounting plate. This may also require that the homeowner fabricate additional holes in the wall to accommodate the electrical wiring and piping for the cooling unit.

Furthermore, many cooling systems such as air conditioners emanate loud noise, which can be a nuisance to some homeowners. This is especially noticeable when the air compressors of the air conditioning units are damaged, thereby resulting with humming, clanking, and buzzing noises.

Therefore, based on the foregoing, there is a need for a new and improved air ventilation system that is simple, quiet, energy efficient, and easy to install without requiring physical modifications to the home or building structure.

SUMMARY OF EMBODIMENTS

To minimize the limitations in the prior art, and to minimize other limitations that will become apparent upon reading and understanding the present disclosure, the present specification discloses a new and improved air ventilation system.

One embodiment may be an air flow control box, comprising: a damper housing; and a damper assembly; wherein the damper housing has a first opening, a second opening, and a ventilation opening; wherein the damper housing defines a passage traversing from a proximal end to a distal end of the damper housing; wherein the first opening is at the proximal end of the damper housing; wherein the second opening is at the distal end of the damper housing; wherein the damper assembly has a closed damper position and an open damper position; wherein the ventilation opening is closable, such that the ventilation opening has an open ventilation position and a closed ventilation position; wherein when the damper assembly is in the closed damper position the ventilation opening is in the open ventilation position; wherein when the damper assembly is in the open damper position the ventilation opening is in the closed ventilation position; wherein the damper assembly blocks the passage when in the closed damper position, such that an air entering the first opening is directed out of the ventilation opening; and wherein the damper assembly allows the air to pass through the passage when in the open damper position, such that the air entering the first opening is directed out of the second opening and not out of the ventilation opening. The damper housing may be positioned between a furnace and a cooling coil, such that the proximal end of the damper housing may be adjacent to the furnace and the distal end of the damper housing is adjacent to the cooling cool.

Another embodiment may be an air ventilation system, comprising: an air flow control box; and a control module; wherein the air flow control box comprises: a damper housing and a damper assembly; wherein the damper housing comprises: a first opening, a second opening, and a ventilation opening; wherein the damper housing defines a passage traversing from a proximal end to a distal end of the damper housing and comprises a ventilation opening; wherein the damper housing defines a passage traversing from a proximal end to a distal end of the damper housing; wherein the first opening is at the proximal end of the damper housing; wherein the second opening is at the distal end of the damper housing; wherein the damper assembly has a closed damper position and an open damper position; wherein the ventilation opening is closable, such that the ventilation opening has an open ventilation position and a closed ventilation position; wherein when the damper assembly is in the closed damper position the ventilation opening is in the open ventilation position; wherein when the damper assembly is in the open damper position the ventilation opening is in the closed ventilation position; wherein the damper assembly blocks the passage when in the closed damper position, such that an air entering the first opening is directed out of the ventilation opening; and wherein the damper assembly allows the air to pass through the passage when in the open damper position, such that the air entering the first opening is directed out of the second opening and not out of the ventilation opening. The damper housing may be positioned between a furnace and a cooling coil, such that the proximal end of the damper housing may be adjacent to the furnace and the distal end of the damper housing is adjacent to the cooling cool. The air flow control box may further comprise: a ventilation cap. The ventilation cap may be positioned over the ventilation opening and may be hingedly connected to the damper housing for a selective ventilation cap movement between an open cap position and a closed cap position, such that, when the ventilation cap is in the closed cap position, the ventilation opening is covered, and when the ventilation cap is in the open cap position, at least a portion of the ventilation opening is uncovered. The damper assembly may comprise a plurality of damper blades; wherein the plurality of damper blades may be disposed substantially in parallel with and adjacent to one another; and wherein each of the plurality of damper blades may be interconnected with one another via at least one first link and is pivotally mounted across a respective portion of the damper assembly, such that each of the plurality of damper blades may be configured to pivot together for a selective damper blades movement between the closed damper position and the open damper position to selectively allow the air to flow from the proximal end to the distal end of the damper housing. The air flow control box may further comprise: one or more control arms and a damper motor; wherein the one or more control arms may be coupled among the damper motor, the ventilation cap, and the at least one first link, such that the damper motor may actuate the selective movements of the ventilation cap and the plurality of damper blades between the open positions and the closed positions; and wherein the control module may be configured to actuate the damper motor. The control module may comprise: a relay; wherein the relay may be electrically coupled and may be operatively interposed among a power source, a furnace control board, the damper motor, and a thermostat, such that the thermostat and the control board are adapted to selectively enable a power delivery from the power source to the damper motor; wherein the control module may further comprise: an auto shut-off timer electrically coupled and operatively interposed between the relay and the power source, such that the auto shut-off timer is also adapted to selectively enable power delivery from the power source to the damper motor. The air flow control box may further comprise: a counterweight; a plurality of vent blades; and at least one spring; wherein the counterweight may be positioned approximately at a proximal end of the first control arm; wherein the plurality of vent blades may be pivotally mounted across the ventilation opening, each of the plurality of vent blades may be disposed substantially in parallel with and adjacent to each another; wherein each of the plurality of vent blades may be interconnected with each other via at least one second link, such that the plurality of vent blades pivot together for selective movement between an open vent blade position and a closed vent blade position; wherein the at least one spring may be located near a proximal end of the vent and is coupled between one of the plurality of vent blades and the damper housing, the at least one spring is adapted to bias the one or more vent blades into the closed vent blade position; wherein the plurality of vent blades may be adapted to be in the open vent blade position when the plurality of vent blades encounter an air pressure above a predetermined level; and wherein the air pressure may result from the air flowing against the damper assembly when the damper assembly is in the closed vent blade position.

Another embodiment may be an air ventilation system, comprising: an air flow control box; and a control module; wherein the air flow control box comprises: a damper housing; a ventilation cap; a damper assembly; a first control arm; a second control arm; and a damper motor; wherein the damper housing defines a passage traversing from a proximal end to a distal end of the damper housing; wherein an upper portion of the damper housing comprises a ventilation opening; wherein the ventilation cap is positioned over the ventilation opening and is hingedly connected to the upper portion of the damper housing for selective movement between an open ventilation cap position and a closed ventilation cap position, such that, when the ventilation cap is in the closed ventilation cap position, the ventilation opening is covered, and when the ventilation cap is in the open ventilation cap position, at least a portion of the ventilation opening is exposed; wherein the damper assembly is in covering relation with the passage with a top portion of the damper assembly being positioned at least behind a distal end of the ventilation opening of the damper housing; wherein the damper assembly comprises a plurality of damper blades, each of the plurality damper blades disposed substantially in parallel with and adjacent to one another; wherein each of the plurality of damper blades are interconnected with each other via at least one first link and is pivotally mounted across a respective portion of the damper assembly, such that each of the plurality of damper blades are configured to pivot together for selective movement between an open damper blade position and a closed damper blade position to selectively allow an air to flow from the proximal end to the distal end of the damper housing; wherein the damper motor is coupled near a center portion of the first control arm and wherein a proximal end of the first control arm is movably coupled to the at least one first link, such that, when the damper motor is actuated, the first control arm articulates the at least one first link for selective movement of the plurality of damper blades between the open position and the closed position; wherein the second control arm is vertically disposed within an opening located at the upper portion of the damper housing, such that a lower portion of the second control arm is substantially within the damper housing; wherein a bottom end of the second control arm is hingedly coupled to a distal end of the first control arm and wherein an upper end of the second control arm is hingedly coupled to the ventilation cap, such that, when the damper motor is actuated, the second control arm vertically moves the ventilation cap between the open ventilation cap position and the closed ventilation cap position; wherein when the damper motor actuates the damper assembly in the closed damper blades position, the ventilation cap is in the open ventilation cap position, and when the damper motor actuates the damper assembly is in the open damper blades position, the ventilation cap is in the closed ventilation cap position; and wherein the control module is configured to actuate the damper motor of the air flow control box for the selective movement of the ventilation cap and the plurality of damper blades between the open damper blades position and the closed damper blades position. The control module may comprise: a double pole double throw (DPDT) relay; and wherein the DPDT relay may be electrically coupled and may be operatively interposed among a power source, a furnace control board, the damper motor, and a thermostat, such that the thermostat and the control board are adapted to selectively enable power delivery from the power source to the damper motor. The control module may further comprise: an auto shut-off timer electrically coupled and operatively interposed between the DPDT relay and the power source, such that the auto shut-off timer is also adapted to selectively enable power delivery from the power source to the damper motor. The control module may further comprise a transformer electrically coupled between the power source and the auto shut-off timer. The air flow control box may further comprise: a counterweight; wherein the counterweight may be slideably connected approximately at a proximal end of the first control arm, such that a load created by the counterweight is adjustable. The air flow control box may further comprise: a plurality of vent blades; at least one spring; and a stopper; wherein the plurality of vent blades may be pivotally mounted across the ventilation opening, each of the plurality of vent blades may be disposed substantially in parallel with and adjacent to one another; wherein each of the plurality of vent blades may be interconnected with each other via at least one second link, such that the plurality of vent blades pivot together for selective movement between an open vent blade position and a closed vent blade position; wherein the at least one spring may be positioned near a proximal end of the vent and may be coupled between one of the plurality of vent blades and the upper portion of the damper housing, and the at least one spring may be adapted to bias the one or more vent blades into the closed vent blade position; wherein the plurality of vent blades may be adapted to be in the open vent blade position, when the plurality of vent blades may encounter an air pressure above a predetermined level; wherein the air pressure may result from the air flowing against the damper assembly when the damper assembly is in the closed damper blades position; and wherein the stopper may be positioned substantially at a distal end of the ventilation opening and is adapted to prevent the plurality of vent blades from blowing open.

Another embodiment may be an air ventilation system for selectively directing furnace air to an attic, comprising: an air flow control box; and a control module; wherein the air flow control box comprises: a damper housing; a ventilation cap; a damper assembly; a first control arm; a second control arm; and a damper motor; wherein the damper housing defines a passage traversing from a proximal end to a distal end of the damper housing; wherein the proximal end of the damper housing is adapted to couple to a furnace; wherein the distal end of the damper housing is adapted to couple to a cooling coil; wherein an upper portion of the damper housing comprises a ventilation opening; wherein the ventilation cap is positioned over the ventilation opening and hingedly connected to the upper portion of the damper housing for selective movement between an open ventilation cap position and a closed ventilation cap position, such that, when the ventilation cap is in the closed position, the ventilation opening is covered, and when the ventilation cap is in the open ventilation cap position, at least a portion of the ventilation opening is exposed; wherein the damper assembly is in covering relation with the passage and is angularly disposed with respect to a longitudinal axis of the passage based on a length of the ventilation opening, such that a top end portion of the damper assembly is positioned approximately below a distal end of the ventilation opening and a bottom end portion of the damper assembly is positioned approximately below a proximal end of the ventilation opening; wherein the damper assembly comprises a plurality of damper blades, each of the plurality of damper blades disposed substantially in parallel with and adjacent to one another; wherein each of the plurality of damper blades are interconnected with each other via at least one first link and is pivotally mounted across a respective portion of the damper assembly, such that each of the plurality of damper blades are configured to pivot together for selective movement between an open position damper blade position and a closed damper blade position to selectively allow an air to flow from the proximal end to the distal end of the damper housing; wherein the damper motor is disposed at a side of the damper housing; wherein the damper motor is coupled near a center portion of the first control arm and wherein a proximal end of the first control arm is movably coupled to the at least one first link, such that, when the damper motor is actuated, the first control arm articulates the at least one first link for selective movement of the plurality of damper blades between the open damper blade position and the closed damper blade position; wherein the second control arm is vertically disposed within an opening located at the upper portion of the damper housing, such that a lower portion of the second control arm is substantially within the damper housing; wherein a bottom end of the second control arm is hingedly coupled to a distal end of the first control arm and wherein an upper end of the second control arm is hingedly coupled to the ventilation cap, such that, when the damper motor is actuated, the second control arm vertically moves the ventilation cap between the open ventilation cap position and the closed ventilation cap position; wherein when the damper motor actuates when the damper assembly in the closed damper blade position, the ventilation cap is in the open ventilation cap position, and when the damper motor actuates when the damper assembly is in the open damper blade position, the ventilation cap is in the closed ventilation cap position; and wherein the control module is configured to actuate the damper motor of the air flow control box for selective movement of the ventilation cap and the plurality of damper blades between the open positions and the closed positions, respectively. The control module may comprise: a double pole double throw (DPDT) relay; and an auto shut-off timer electrically; wherein the DPDT relay may be electrically coupled and may be operatively interposed among a power source, a control board, the damper motor, and a thermostat, such that the thermostat and the control board are adapted to selectively enable power delivery from the power source to the damper motor; wherein the auto shut-off timer may be electrically coupled and operatively interposed between the DPDT relay and the power source, such that the auto shut-off timer is also adapted to selectively enable power delivery from the power source to the damper motor. The control module may further comprise a transformer electrically coupled between the power source and the auto shut-off timer. The air flow control box may further comprise: a counterweight; wherein the counterweight may be slideably connected approximately at a proximal end of the first control arm, such that a load created by the counterweight is adjustable; wherein the air flow control box may further comprise: a plurality of vent blades; at least one spring; and a stopper; wherein the plurality of vent blades may be pivotally mounted across the ventilation opening, each of the plurality of vent blades may be disposed substantially in parallel with and adjacent to each another; wherein the plurality of vent blades may be interconnected with each other via at least one second link, such that the plurality of vent blades pivot together for selective movement between an open vent blade position and a closed vent blade position; wherein the at least one spring may be located near a proximal end of the vent and may be coupled between one of the plurality of vent blades and the upper portion of the damper housing, the at least one spring is adapted to bias the one or more vent blades into the closed vent blade position; wherein the plurality of vent blades may be adapted to be in the open vent blade position, when the plurality of vent blades encounters an air pressure above a predetermined level; wherein the air pressure may result from the air flowing against the damper assembly when the damper assembly is in the closed damper blade position; and wherein the stopper may be positioned near a distal end of the ventilation opening and is adapted to prevent the plurality of vent blades from blowing open.

Another embodiment may be an air ventilation system, comprising: an air flow control box; and a control module; wherein the air flow control box may comprise: a damper housing, a ventilation cap, a damper assembly, one or more control arms, and a damper motor; wherein the damper housing may define a passage traversing from a proximal end to a distal end of the damper housing and may comprise a ventilation opening; wherein the ventilation cap may be positioned over the ventilation opening and may be hingedly connected to the damper housing for selective movement between an open position and a closed position, such that, when the ventilation cap is in the closed position, the ventilation opening is covered, and when the ventilation cap is in the open position, at least a portion of the ventilation opening is exposed; wherein the damper assembly may be in covering relation with the passage and may be positioned behind a distal end of the ventilation opening; wherein the damper assembly may comprise a plurality of damper blades, each of the damper blades disposed substantially in parallel with and adjacent to one another; wherein each of the plurality of damper blades may be interconnected with each other via at least one first link and may be pivotally mounted across a respective portion of the damper assembly, such that each of the plurality of damper blades may be configured to pivot together for selective movement between an open position and a closed position to selectively allow an air to flow from the proximal end to the distal end of the damper housing; wherein the one or more control arms may be coupled among the damper motor, the ventilation cap, and the at least one first link in order for the damper motor to actuate the selective movement of the ventilation cap and the plurality of damper blades between the open position and the closed position; and wherein when the damper motor actuates the damper assembly in the closed position, the ventilation cap may be in the open position, and when the damper motor actuates the damper assembly is in the open position, the ventilation cap may be in the closed position; wherein the control module may be configured to actuate the damper motor of the air flow control box. The one or more control arms may comprise: a first control arm; and a second control arm; wherein the damper motor may be coupled near a center portion of the first control arm and wherein a proximal end of the first control arm may be movably coupled to the at least one first link, such that, when the damper motor is actuated, the first control arm articulates the at least one first link for selective movement of the plurality of damper blades between the open position and the closed position; wherein the second control arm may be vertically disposed within an opening located at the upper portion of the damper housing, such that a lower portion of the second control arm may be substantially within the damper housing; and wherein a bottom end of the second control arm may be hingedly coupled to a distal end of the first control arm and wherein an upper end of the second control arm may be hingedly coupled to the ventilation cap, such that, when the damper motor is actuated, the second control arm vertically moves the ventilation cap between the open position and the closed position. The control module may comprise: a relay and a control board; wherein the relay may be electrically coupled and may be operatively interposed among a power source, the control board, the damper motor, and a thermostat, such that the thermostat and the control board may be adapted to selectively enable a power delivery from the power source to the damper motor. The control module may further comprise: an auto shut-off timer electrically coupled and operatively interposed between the relay and the power source, such that the auto shut-off timer may also be adapted to selectively enable power delivery from the power source to the damper motor. The control module may further comprise a transformer electrically coupled between the power source and the auto shut-off timer. The air flow control box may further comprise: a counterweight; wherein the counterweight may be positioned approximately at a proximal end of the first control arm. The air flow control box may further comprise: a plurality of vent blades and at least one spring; wherein the plurality of vent blades may be pivotally mounted across the ventilation opening, each of the plurality of vent blades may be disposed substantially in parallel with and adjacent to each another; wherein each of the plurality of vent blades may be interconnected with each other via at least one second link, such that the plurality of vent blades may pivot together for selective movement between an open position and a closed position; wherein the at least one spring may be located near a proximal end of the vent and may be coupled between one of the plurality of vent blades and the damper housing, the at least one spring may be adapted to bias the one or more vent blades into the closed position; and wherein the plurality of vent blades may be adapted to be in the open position, when the plurality of vent blades encounters an air pressure above a predetermined level, the air pressure resulting from the air flowing against the damper assembly when the damper assembly is in the closed position.

Another embodiment may be an air ventilation system, comprising: an air flow control box and a control module; wherein the air flow control box may comprise: a damper housing, a ventilation cap, a damper assembly, a first control arm, a second control arm, and a damper motor; wherein the damper housing may define a passage traversing from a proximal end to a distal end of the damper housing; wherein the proximal end and the distal end of the damper housing may be adapted to couple to one or more air ducts; wherein an upper portion of the damper housing may comprise a ventilation opening; wherein the ventilation cap may be positioned over the ventilation opening and may be hingedly connected to the upper portion of the damper housing for selective movement between an open position and a closed position, such that, when the ventilation cap is in the closed position, the ventilation opening may be covered, and when the ventilation cap is in the open position, at least a portion of the ventilation opening may be exposed; wherein the damper assembly may be in covering relation with the passage with a top portion of the damper assembly being positioned at least behind a distal end of the ventilation opening of the damper housing; wherein the damper assembly may comprise a plurality of damper blades, each of the damper blades disposed substantially in parallel with and adjacent to one another; wherein each of the plurality of damper blades may be interconnected with each other via at least one first link and may be pivotally mounted across a respective portion of the damper assembly, such that each of the plurality of damper blades may be configured to pivot together for selective movement between an open position and a closed position to selectively allow an air to flow from the proximal end to the distal end of the damper housing; wherein the damper motor may be coupled near a center portion of the first control arm and wherein a proximal end of the first control arm may be movably coupled to the at least one first link, such that, when the damper motor is actuated, the first control arm may articulate the at least one first link for selective movement of the plurality of damper blades between the open position and the closed position; wherein the second control arm may be vertically disposed within an opening located at the upper portion of the damper housing, such that a lower portion of the second control arm may be substantially within the damper housing; wherein a bottom end of the second control arm may be hingedly coupled to a distal end of the first control arm and wherein an upper end of the second control arm may be hingedly coupled to the ventilation cap, such that, when the damper motor is actuated, the second control arm may vertically move the ventilation cap between the open position and the closed position; and wherein when the damper motor actuates the damper assembly in the closed position, the ventilation cap may be in the open position, and when the damper motor actuates the damper assembly is in the open position, the ventilation cap may be in the closed position; wherein the control module may be configured to actuate the damper motor of the air flow control box for the selective movement of the ventilation cap and the plurality of damper blades between the open position and the closed position. The control module may comprise: a double pole double throw (DPDT) relay and a control board; wherein the DPDT relay may be electrically coupled and may be operatively interposed among a power source, the control board, the damper motor, and a thermostat, such that the thermostat and the control board may be adapted to selectively enable power delivery from the power source to the damper motor. The control module may further comprise: an auto shut-off timer electrically coupled and operatively interposed between the DPDT relay and the power source, such that the auto shut-off timer may also be adapted to selectively enable power delivery from the power source to the damper motor. The control module may further comprise a transformer electrically coupled between the power source and the auto shut-off timer. The air flow control box may further comprise: a counterweight; wherein the counterweight may be slideably connected approximately at a proximal end of the first control arm, such that a load created by the counterweight may be adjustable. The air flow control box may further comprise: a plurality of vent blades, at least one spring, and a stopper; wherein the plurality of vent blades may be pivotally mounted across the ventilation opening, each of the plurality of vent blades is disposed substantially in parallel with and adjacent to one another; wherein each of the plurality of vent blades may be interconnected with each other via at least one second link, such that the plurality of vent blades may pivot together for selective movement between an open position and a closed position; wherein the at least one spring may be positioned near a proximal end of the vent and may be coupled between one of the plurality of vent blades and the upper portion of the damper housing, the at least one spring being adapted to bias the one or more vent blades into the closed position; wherein the plurality of vent blades may be adapted to be in the open position, when the plurality of vent blades encounters an air pressure above a predetermined level, the air pressure resulting from the air flowing against the damper assembly when the damper assembly is in the closed position; and wherein the stopper may be positioned near a distal end of the ventilation opening and may be adapted to prevent the plurality of vent blades from blowing over.

Another embodiment may be an air ventilation system for selectively directing furnace air to an attic, comprising: an air flow control box and a control module; wherein the air flow control box may comprise: a damper housing, a ventilation cap, a damper assembly, a first control arm, a second control arm, and a damper motor; wherein the damper housing may define a passage traversing from a proximal end to a distal end of the damper housing; wherein the proximal end of the damper housing may be adapted to couple to a furnace air duct; wherein the distal end of the damper housing may be adapted to couple to a cooling coil air duct; wherein an upper portion of the damper housing may comprise a ventilation opening; wherein the ventilation cap may be positioned over the ventilation opening and may be hingedly connected to the upper portion of the damper housing for selective movement between an open position and a closed position, such that, when the ventilation cap is in the closed position, the ventilation opening may be covered, and when the ventilation cap is in the open position, at least a portion of the ventilation opening may be exposed; wherein the damper assembly may be in covering relation with the passage and may be angularly disposed with respect to a longitudinal axis of the passage based on a length of the ventilation opening, such that a top end portion of the damper assembly may be positioned approximately below a distal end of the ventilation opening and a bottom end portion of the damper assembly may be positioned approximately below a proximal end of the ventilation opening; wherein the damper assembly may comprise a plurality of damper blades, each of the damper blades being disposed substantially in parallel with and adjacent to one another; wherein each of the plurality of damper blades may be interconnected with each other via at least one first link and may be pivotally mounted across a respective portion of the damper assembly, such that each of the plurality of damper blades may be configured to pivot together for selective movement between an open position and a closed position to selectively allow an air to flow from the proximal end to the distal end of the damper housing; wherein the damper motor may be disposed at a side of the damper housing; wherein the damper motor may be coupled near a center portion of the first control arm and wherein a proximal end of the first control arm may be movably coupled to the at least one first link, such that, when the damper motor is actuated, the first control arm may articulate the at least one first link for selective movement of the plurality of damper blades between the open position and the closed position; wherein the second control arm may be vertically disposed within an opening located at the upper portion of the damper housing, such that a lower portion of the second control arm may be substantially within the damper housing; wherein a bottom end of the second control arm may be hingedly coupled to a distal end of the first control arm and wherein an upper end of the second control arm may be hingedly coupled to the ventilation cap, such that, when the damper motor is actuated, the second control arm may vertically move the ventilation cap between the open position and the closed position; and wherein when the damper motor actuates the damper assembly in the closed position, the ventilation cap may be in the open position, and when the damper motor actuates the damper assembly in the open position, the ventilation cap may be in the closed position; wherein the control module may be configured to actuate the damper motor of the air flow control box for the selective movement of the ventilation cap and the plurality of damper blades between the open position and the closed position. The control module may comprise: a DPDT relay and a control board; wherein the DPDT relay may be electrically coupled and may be operatively interposed among a power source, the control board, the damper motor, and a thermostat, such that the thermostat and the control board may be adapted to selectively enable power delivery from the power source to the damper motor. The control module may further comprise: an auto shut-off timer electrically coupled and operatively interposed between the DPDT relay and the power source, such that the auto shut-off timer may also be adapted to selectively enable power delivery from the power source to the damper motor. The control module may further comprise a transformer electrically coupled between the power source and the auto shut-off timer. The air flow control box may further comprise: a counterweight; wherein the counterweight may be slideably connected approximately at a proximal end of the first control arm, such that a load created by the counterweight is adjustable. The air flow control box may further comprise: a plurality of vent blades, at least one spring and a stopper; wherein the plurality of vent blades may be pivotally mounted across the ventilation opening, each of the plurality of vent blades being disposed substantially in parallel with and adjacent to each another; wherein the plurality of vent blades may be interconnected with each other via at least one second link, such that the plurality of vent blades may pivot together for selective movement between an open position and a closed position; wherein the at least one spring may be located near a proximal end of the vent and may be coupled between one of the plurality of vent blades and the upper portion of the damper housing, the at least one spring being adapted to bias the one or more vent blades into the closed position; wherein the plurality of vent blades may be adapted to be in the open position, when the plurality of vent blades encounters an air pressure above a predetermined level, the air pressure resulting from the air flowing against the damper assembly when the damper assembly is in the closed position; and wherein the stopper may be positioned near a distal end of the ventilation opening and may be adapted to prevent the plurality of vent blades from blowing over. The air flow control box may be located within an attic of a dwelling structure.

It is an object to provide a new and improved air ventilation system that is simple, quiet, energy efficient, and easy to install without requiring substantial physical modifications to the home or building structure. Most home heating and cooling systems generally expend a substantial amount of energy for their operation, especially to remove heat and provide cool air. This generally represents an energy loss because the heat itself is a form of energy. Thus, the new and improved air ventilation system preferably utilizes this heat so that it could be recaptured for preserving energy.

It is an object to provide a new and improved air ventilation system that substantially eliminates the homeowners from hearing loud noises emanating from an operating ventilation system. Some compressors of air conditioning units may create humming, clanking, and buzzing noises, which can be a nuisance to some homeowners. This is especially true if the air conditioner is running during the evening when the homeowner and/or residents are asleep.

It is an object to provide a new and improved air ventilation system that does not require substantial physical modifications to an individual's home. For example, when installing the new and improved air ventilation system disclosed herein, the homeowner or user preferably will not be required to fabricate holes to a wall in order to run electrical wires or piping to that home.

It is an object to provide new and improved air ventilation system that helps remove indoor odors by redirecting such odors outside the home or building.

It is an object to provide a new and improved air ventilation system that transfers outdoor fresh air inside the home.

It is an object to provide a new and improved air ventilation system that utilizes the home's furnace blower. This will help conserve energy while cooling the home.

It is an object to overcome the deficiencies of the prior art.

These, as well as other components, steps, features, objects, benefits, and advantages, will now become clear from a review of the following detailed description of illustrative embodiments, of the accompanying drawings, and of the claims.

BRIEF DESCRIPTION OF THE ILLUSTRATIVE EMBODIMENTS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF THE ILLUSTRATIVE EMBODIMENTS

Figure 1:
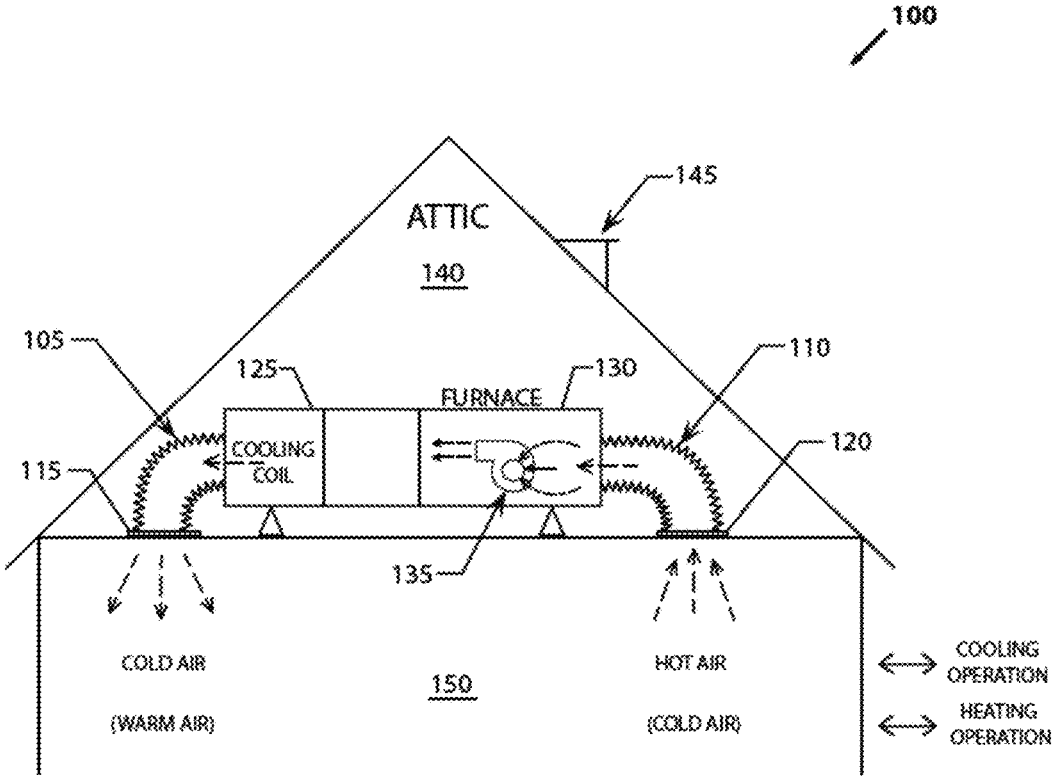
FIG. 1 (Prior Art)
FIG. 1 is an illustration of a conventional central air conditioning and heating system.

In the following detailed description of various embodiments, numerous specific details are set forth in order to provide a thorough understanding of various aspects of the embodiments. However, the embodiments may be practiced without some or all of these specific details. In other instances, well-known procedures and/or components have not been described in detail so as not to unnecessarily obscure aspects of the embodiments.

While some embodiments are disclosed here, other embodiments will become obvious to those skilled in the art as a result of the following detailed description. These embodiments are capable of modifications of various obvious aspects, all without departing from the spirit and scope of protection. The Figures, and their detailed descriptions, are to be regarded as illustrative in nature and not restrictive. Also, the reference or non-reference to a particular embodiment shall not be interpreted to limit the scope of protection.

It should also be understood that some of the functional units described in this specification have been labeled as modules, in order to more particularly emphasize their implementation independence. For example, a module may be implemented as a hardware circuit comprising custom VLSI circuits or gate arrays, off-the-shelf semiconductors such as logic chips, transistors, relays, or other discrete components. A module may also be implemented in programmable hardware devices such as field programmable gate arrays, programmable array logic, programmable logic devices or the like.

Modules may also be implemented in software for execution by various types of processors. An identified module of executable code may, for instance, comprise one or more physical or logical blocks of computer instructions, which may, for instance, be organized as an object, procedure, or function. Nevertheless, the executables of an identified module need not be physically located together, but may comprise disparate instructions stored in different locations which, when joined logically together, comprise the module and achieve the stated purpose for the module.

Indeed, a module of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network. The modules may be passive or active, including agents operable to perform desired functions. Reference throughout this specification to "one embodiment", "an embodiment", or "another embodiment" may mean that a particular feature, structure, or characteristic described in connection with the embodiment may be included in at least one embodiment of the present disclosure. Thus, appearances of the phrases "in one embodiment" or "in an embodiment" in various places throughout this specification may not necessarily refer to the same embodiment.

Furthermore, the described features, structures, or characteristics may be combined in any suitable manner in one or more embodiments. In the following description, numerous specific details are provided, such as examples of materials, fasteners, sizes, lengths, widths, shapes, etc., to provide a thorough understanding of the embodiments. One skilled in the relevant art will recognize, however, that the scope of protection can be practiced without one or more of the specific details, or with other methods, components, materials, etc. In other instances, well-known structures, materials, or operations are generally not shown or described in detail to avoid obscuring aspects of the disclosure.

Definitions

In the following description, certain terminology is used to describe certain features of one or more embodiments. For purposes of the specification, unless otherwise specified, the term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking the nearness of completion will be so as to have the same overall result as if absolute and total completion were obtained. The use of "substantially" is also equally applicable when used in a negative connotation to refer to the complete or near complete lack of an action, characteristic, property, state, structure, item, or result.

As used herein, the terms "approximately" and "about" generally refer to a deviance of within 5% of the indicated number or range of numbers. In one embodiment, the term "approximately" and "about", may refer to a deviance of between 1-10% from the indicated number or range of numbers.

The present specification discloses a new and improved air ventilation system. The system may comprise an air flow control box and a control module, wherein the air flow control box may comprise: a damper housing, ventilation cap, damper assembly, control arms, and damper motor. The damper housing may define a passage traversing from a proximal end to a distal end of the damper housing and may comprise a ventilation opening. The ventilation cap may be hingedly connected to the damper housing for selective movement between an open position and a closed position. The damper assembly may be in covering relation with the passage and may comprise damper blades that pivot together for selective movement between an open position and a closed position. The damper motor may actuate the selective movement of the ventilation cap and the plurality of damper blades via the control arms. The control module may actuate the damper motor of the air flow control box.

FIG. 1 is an illustration of a conventional central air conditioning and heating system. As shown in FIG. 1, a conventional central air conditioning and heating system 100 may comprise: supply air ducts 105, return air ducts 110, supply air grills 115, return air grills 120, cooling coil 125, furnace 130, blower 135, and roof vent 145. FIG. 1 shows that the cooling coil 125 (or evaporator) and furnace 130 may be located in the attic 140 of a home or building structure and are preferably connected to each other via air ducts. FIG. 1 also shows that the return air ducts 110 are preferably connected between the furnace 130 and the return air grills 120, so that air from the interior space 150 of the home may be drawn into the return air grills 120 and into the furnace 130. The supply air ducts 105 are also preferably connected between the cooling coil 125 and supply air grills 115. This preferably allows air released from the cooling coil 125 to be redirected to the interior space 150 of the home.

FIG. 1 also shows the heating and cooling operation of a conventional central air conditioning and heating system. In a normal cooling operation, indoor air located inside the interior space 150 of a home is drawn into the return air grills 120, through the return air ducts 110 and into the furnace 130 via the blower 135. As the indoor air is drawn into the blower 135 and furnace 130, which is off, the drawn air is then blown across the cooling coil 125. Liquid air conditioning refrigerant entering the cooling coil through a metering device increasingly changes into gas form, and this state change (i.e., from liquid to gas refrigerant) absorbs energy, thereby cooling the tubing and fins of the cooling coil. As a result, air blown from the furnace and across the cooling coil 125 is then cooled and dehumidified indirectly. This cooled air is then transferred to the supply air ducts 105 and transferred through the supply air grills 115 into the interior space 150 of the home.

During a normal heating operation, the blower 135 draws indoor air into the return air grills 120, through the return air ducts 110 and into the furnace 130. The drawn air is heated by the furnace and is then redirected into the cooling coil 125, which is off, through the supply air ducts 105, and through the supply air grills 115. Preferably, the cooling coil 125 is not activated, so that the drawn air is no longer cooled.

Accordingly, in both heating and cooling operations, air is generally drawn into the return air grills 120, through the return air ducts 110 and into the furnace 130 via the blower 135. The drawn air is then sent into the cooling coil 125, supply air ducts 105, and through the supply air grills 115, into the interior space 150 of the home. The cooling coil 125 and furnace 130, are typically activated or deactivated, depending upon the type of operation (i.e., heating, cooling).

Figure 2:
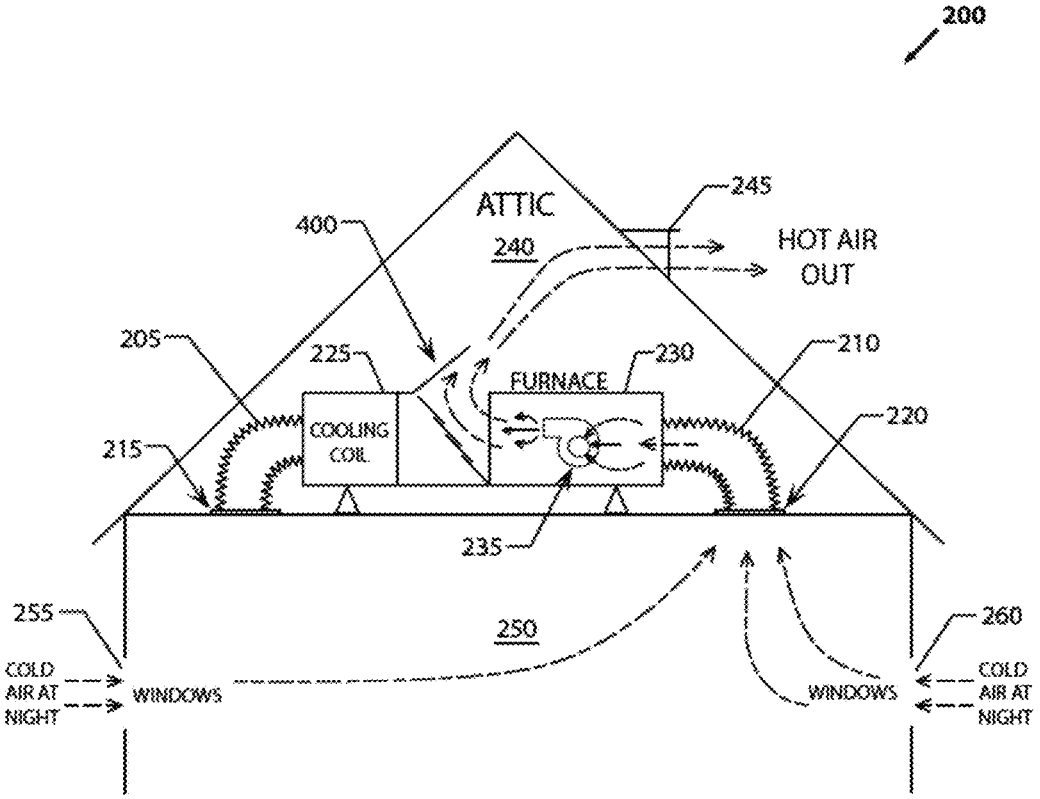
FIG. 2 is an illustration of one embodiment of the air ventilation system installed with the central air conditioning and heating system with the ventilation cap in the open position.

FIG. 2 is an illustration of one embodiment of the air ventilation system installed with the central air conditioning and heating system with the ventilation cap in the open position. As shown in FIG. 2, one embodiment of the central air conditioning and heating system with the air ventilation system 200 may comprise: supply air ducts 205, return air ducts 210, supply air grills 215, return air grills 220, cooling coil 225, furnace 230, blower 235, and air flow control box 400. Unlike the central air conditioning and heating system shown in FIG. 1, the central air conditioning and heating system in FIG. 2 shows the addition of one embodiment of the air ventilation system 200, which generally comprises an air flow control box 400 and a control module 600 (shown in FIG. 6). The air flow control box 400 is preferably coupled between the cooling coil 225 and furnace 230. In this configuration, air flow control box 400 may control the air entering the cooling coil 225 from the furnace 230. For example, in one embodiment, shown in FIG. 2, the air flow control box 400 may prevent the air blown by blower 235 to be directed across the cooling coil 225, and instead, redirect that air flow into the attic 240 of the home. This may be accomplished by actuating the damper assembly 415 of the air flow control box 400 into the closed position and actuating the ventilation cap 410 into the open position. Thus, once the air is directed to the attic 240, the air is then preferably released into the atmosphere through a roof vent 245 of the attic 240. Preferably, the control module 600 may actuate the damper motor of the air flow control box 400 to control the direction of air flow of the air ventilation system 200.

FIG. 2 also shows the operation of the central air conditioning and heating system in use with one embodiment of the air ventilation system 200. As the blower 235 of the furnace 230 draws air from the interior space 250 of the home, outside cool air may be drawn into the home through the windows 255, 260. The blower 235 may be used with or without the cooling coil 225 or the heating unit in the furnace 230 operating. This outside cool air preferably cools the interior of the home, especially during hot summer nights. Meanwhile, rather than sending the drawn furnace air through the cooling coil 225, through the supply air ducts 205, and then into the interior space 250 of the home via the supply air grills 215, the warm air that rises and brought into the furnace 230 may be redirected into the attic 240 and vented into the atmosphere via the roof vent 245. This preferably allows any heat accumulated in the attic 240 to be released, thereby cooling the attic 240. In this manner, cool air is preferably continually brought into the home or building structure and heated air is released into the atmosphere through the attic.

Figure 3:
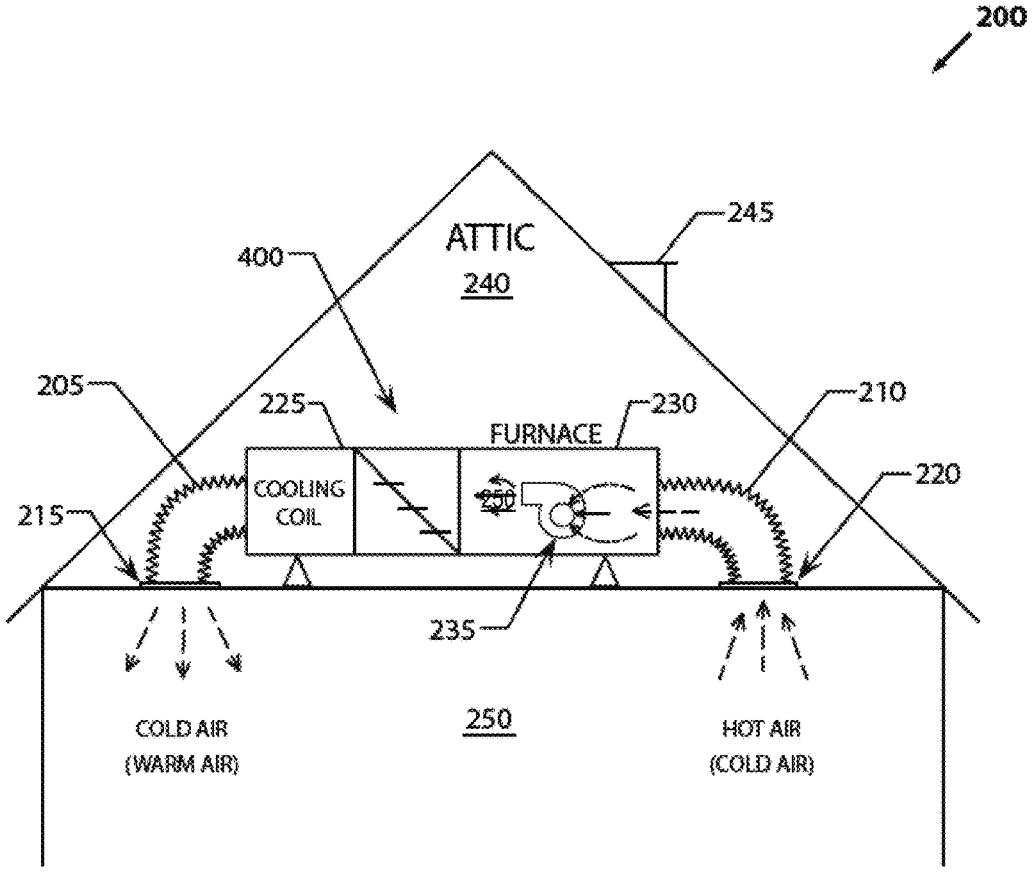
FIG. 3 is an illustration of one embodiment of the air ventilation system in the closed position.

FIG. 3 is an illustration of one embodiment of the air ventilation system in the closed position. As shown in FIG. 3, one embodiment of the central air conditioning and heating system with the air ventilation system 200 may comprise: supply air ducts 205, return air ducts 210, supply air grills 215, return air grills 220, cooling coil 225, furnace 230, blower 235, and air flow control box 400. Like in FIG. 2, the central air conditioning and heating system in FIG. 3 shows the addition of one embodiment of the air ventilation system 200, which generally comprises an air flow control box 400 and a control module 600 (shown in FIG. 6). Preferably, the air flow control box 400 is coupled and/or situated between the cooling coil 225 and furnace 230. This configuration preferably allows the air flow control box 400 to control the air entering the cooling coil 225 from the furnace 230. For example, FIG. 3 shows that the air flow control box 400 may allow the air blown by blower 235 to be directed across the cooling coil 225, thereby causing the air to be cooled and redirected back into the interior space 150 of the home through supply air ducts 205.

Specifically, the blower 235 of the furnace 230 may draw air from the interior space 250 of the home and to the air flow control box 400. The air flow control box 400 may then direct that drawn air to through the cooling coil 225 rather than to the attic 240 by opening the damper assembly 415 (shown in FIG. 4) and closing the ventilation cap 410 (also shown in FIG. 4). After passing through the cooling coil 225, the drawn air may pass through the supply air ducts 205, and then into the interior space 250 of the home via the supply air grills 215. Depending upon whether the cooling coil 225 and furnace 230 is activated, the air may be cooled or heated. In this manner, cool or heated air may be circulated in the home or building structure. In an alternative embodiment, the air flow control box 400 may also redirect air flow to various parts of the home through the use of additional ducting. In another embodiment, the air passed through the furnace 230, air flow control box 400, and cooling coil 225 is not heated or cooled.

Figure 4:
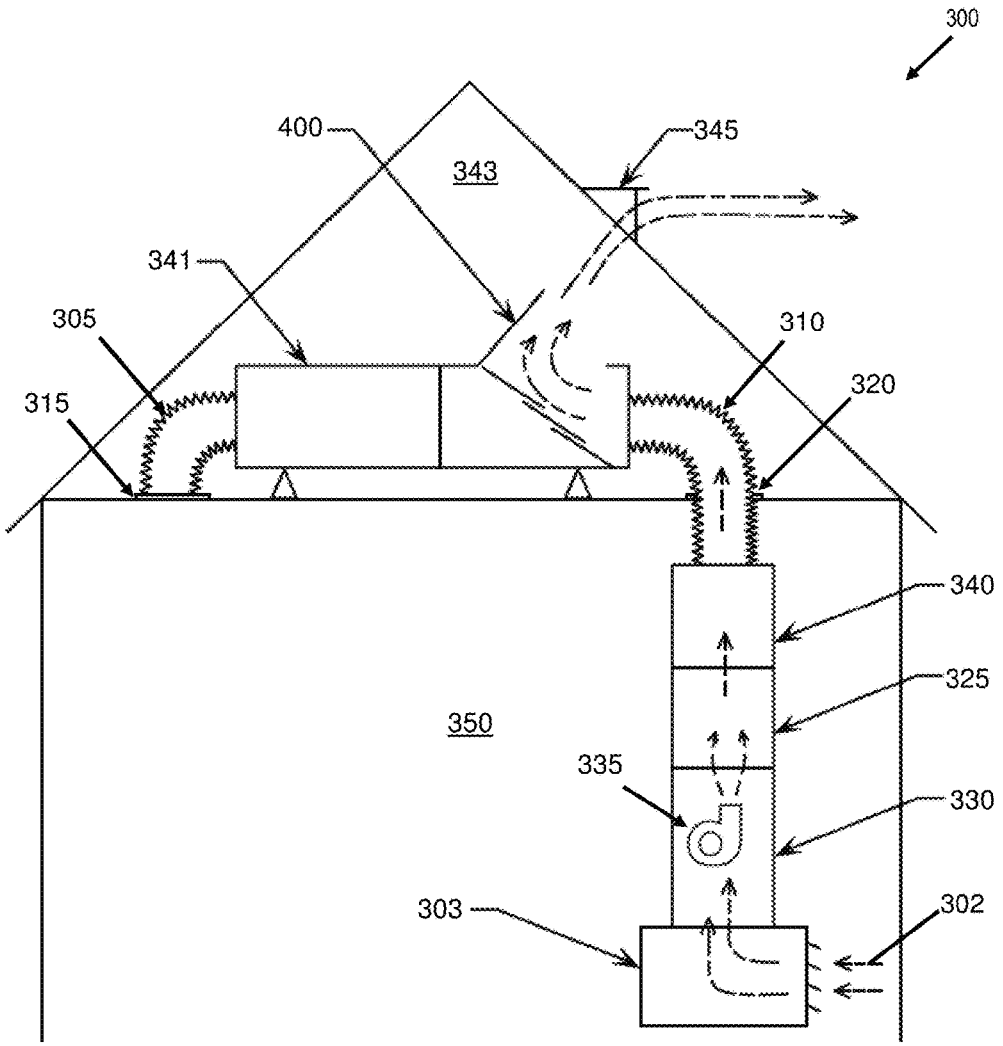
FIG. 4 is an illustration of another embodiment of the air ventilation system with a plenum and up-flow cooling coil.

FIG. 4 is an illustration of another embodiment of the air ventilation system with a plenum and up-flow cooling coil. As shown in FIG. 4, another embodiment of the central air conditioning and heating system with the air ventilation system 300 may comprise: a return box 303, supply air ducts 305, return air ducts 310, supply air grills 315, return air grills 320, up-flow cooling coil 325, furnace 330, blower 335, plenums 340, 341, and air flow control box 400. Unlike the central air conditioning and heating system shown in FIGS. 2 and 3, the central air conditioning and heating system in FIG. 4 shows the up-flow cooling coil 325, furnace 330, and blower 335 within the interior space 350 of the home. FIG. 4 also shows that the air ventilation system 300 may include a return box 303 for receiving indoor return air 302 and additional plenums 340, 341, which are generally separate spaces provided for air circulation and may serve as a receiving chamber for air that has been heated or cooled to be distributed to the building.

FIG. 4 also shows the operation of the central air conditioning and heating system in use with this embodiment of the air ventilation system 300. As the blower 335 of the furnace 330 draws air from the interior space 350 of the home, indoor return air 302 may be drawn into the return box 303. Alternatively, outside cool air may also be drawn into the home through the windows. The indoor return air 302 and/or outside cool air is preferably communicated to the air flow control box 400 via the up-flow cooling coil 325, plenum 340, return air duct 310, and return air grill 320. Meanwhile, rather than sending the drawn air through the plenum 341, through the supply air ducts 305, and then into the interior space 350 of the home via the supply air grills 315, the indoor return air 302 may be redirected into the attic 343 and vented into the atmosphere via the roof vent 345. This preferably allows any heat accumulated in the attic 343 to be released, thereby cooling the attic 343. In this manner, cool air is preferably continually brought into the home or building structure and heated air is released into the atmosphere through the attic.

Figure 5:
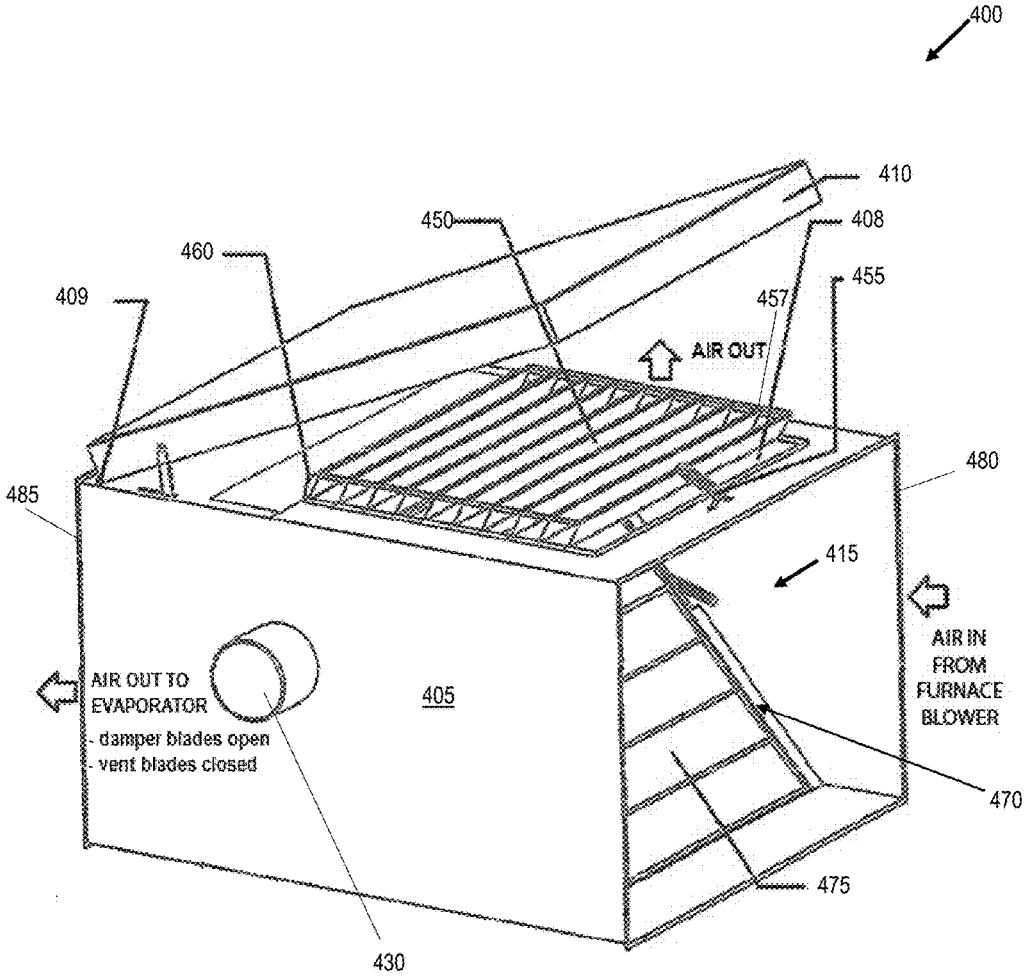
FIG. 5 is an illustration of a perspective view of one embodiment of an air flow control box and shows the ventilation cap in the open position.

FIG. 5 is an illustration of a perspective view of one embodiment of an air flow control box and shows the ventilation cap in the open position. As shown in FIG. 5, one embodiment of the air flow control box 400 may comprise: a damper housing 405, ventilation cap 410, damper assembly 415, control arms (e.g., first control arm 420, second control arm 425) (both shown in FIG. 6), damper motor 430, ventilation blades 450, spring 455, and stopper 460. FIG. 5 also shows that the damper assembly 415 may comprise a link 470 and damper blades 475. As preferred, FIG. 5 shows that, when the ventilation cap 410 is in an open position, the damper blades 475 are preferably in a closed position.

In particular, FIG. 5 shows that the air flow control box 400 may comprise a damper housing 405, which may be any rigid casing shaped as a channel with a substantially contained passage for the transfer of air. The damper housing 405 may also enclose and protect one or more pieces of moving components such as the damper motor 430 and damper assembly 415. In one embodiment, the damper housing 405 may be shaped as a channel with a passage traversing or extending from a proximal end 480 of the damper housing 405 to a distal end 485 of the damper housing 405, but the passage may traverse in different directions of the damper housing 405. The proximal end 480 of the damper housing 405 is preferably configured to connect or couple with an air duct of the furnace 230, so that air drawn from the blower 235 is directed into the proximal end 480 of the damper housing 405. Additionally, the distal end 485 of said damper housing is preferably configured or adapted to connect or couple with the housing of cooling coil 225.

FIG. 5 also shows that the damper housing 405 may also comprise a ventilation opening 408 and ventilation cap 410. The ventilation opening 408 may be positioned at the upper portion of the damper housing 405 and may allow air from the furnace to flow out of the damper housing 405 and into the attic 240. The ventilation cap 410 may also be positioned over the ventilation opening 408 and may be connected to the upper portion of said damper housing 405 via a hinge 409. This may allow the ventilation cap 410 to change between an open position and a closed position. Thus, in one embodiment, when the ventilation cap 410 is in the closed position, the ventilation opening 408 is preferably covered. On the other hand, when the ventilation cap 410 is in the open position, the ventilation opening 408 or a portion thereof is preferably exposed and is not covered by ventilation cap 410. In this manner, when the ventilation cap 410 is closed, air from the furnace preferably cannot be released through the ventilation opening 408, whereas, when the ventilation cap 410 is in the open position, furnace air may be released through the ventilation opening 408. Although FIG. 5 shows that the ventilation opening 408 is positioned at the upper portion of the damper housing 405, the ventilation opening 408 may also be positioned at the sides or bottom of the damper housing 405, so long as the ventilation cap 410 is capable of covering and uncovering the ventilation opening 408. In another embodiment, the ventilation cap and ventilation opening may be configured to be damper blades that open and close similar to damper blades 475.

FIG. 5 also shows that the air flow control box 400 may comprise a damper assembly 415. The damper assembly 415 is generally a device or component for regulating the air flow traveling from the furnace 235 and into the damper housing 405. The damper assembly 415 may comprise a plurality of damper blades 475, each of which are preferably disposed in parallel manner and substantially adjacent to one another. Preferably, the damper blades are interconnected with each other via one or more links 470 and are pivotally mounted across a respective portion of the damper assembly 415. This preferably allows the damper blades 475 to pivot together between open and closed positions, which will allow the damper assembly 415 to selectively allow air flow from the proximal end 480 to the distal end 485 of said damper housing 405.

The damper assembly 415 is preferably located within the damper housing 405 and preferably covers the passage of the damper housing 405. In a preferred embodiment, the damper assembly 415 is positioned behind the ventilation opening 408 with respect to the proximal end 480 of the damper housing 405. This may allow the damper assembly 415 to control the air flow from the proximal end 480 of the damper housing 405 to either: (1) the distal end 485 of the damper housing 405 or (2) ventilation opening 408. This may allow the air flow control box 400 to release air either towards the cooling coil 225 or into the attic 240.

In one embodiment, the damper assembly 415 may be disposed in a vertical configuration, such that the damper blades 475 are aligned above each other vertically. In another embodiment, as shown in FIG. 2, the damper assembly 415 may be disposed in an angular or diagonal position, such that the top end portion of the damper assembly 415 is aligned near the distal end of the ventilation opening 408 and the bottom portion of the damper assembly 415 is in vertical alignment with the proximal end portion of the ventilation opening 408. In this embodiment, the air flow control box 400 is preferably angled on a diagonal to provide better air flow to either the ventilation opening 408 or the distal end 485 of the damper housing 405, so that, when the damper assembly 415 is in the closed position, the air may travel from the furnace 230 and into the ventilation opening 408 more efficiently.

FIG. 5 also shows that the air flow control box 400 may comprise a damper motor 430. The damper motor 430 is preferably a component or device that supplies motive power to actuate the damper assembly 415 and/or ventilation cap 410. The damper motor 430 preferably provides directional and rotational displacement of the damper blades 475 of the damper assembly 415 and/or may be configured to actuate the control anus 420, 425 in order to move ventilation cap 410 between the open and closed positions. In one embodiment, the damper motor 430 may be positioned at the side of the air flow control box 400 and the shaft of the damper motor 430 may be coupled or connected to near a center portion of the first control arm 420. Although FIG. 5 shows the damper motor positioned at the side of the damper housing 405, the damper motor 430 may be positioned anywhere on the damper housing 405 such as at the top or bottom. Additionally, although FIG. 5 shows a single damper motor, additional damper motors may be implemented to actuate the damper assembly and/or ventilation cap. For example, in another embodiment, two damper motors may be positioned at both the left side and right side of the damper housing.

In one embodiment, the damper blades 475 of the damper assembly 415 may be pivotally coupled to the link 470, and the link 470 may be movably coupled to the damper motor 430 via the first control arm 420. This may allow the damper motor 430, when actuated, to move or articulate the link 470 for selective movement of the damper blades between the open and closed positions. Additionally, the ventilation cap 410 may be hingedly coupled to the first control arm 420 via the second control arm 425. This may also allow the damper motor 430, when actuated, to move or articulate second control arm 425 for selective movement of the ventilation cap 410 between the open and closed positions. In one embodiment, the damper housing 405 may comprise an opening at the top, and the second control arm 425 may be positioned within that opening, such that a bottom portion of the second control arm 425 is substantially within the damper housing 405, and an upper portion of the second control arm 425 is positioned outside the damper housing 405. The upper portion of the second control arm 425 may be coupled to the inner portion of the ventilation cap 410.

In a preferred embodiment, the damper motor 430 preferably actuates the damper blades 475 and ventilation cap 410 in opposing open and closed positions. Specifically, when the damper motor 430 actuates the damper assembly 415 into the closed position, the ventilation cap 410 is preferably in the open position, and when the damper motor 430 actuates the damper assembly 415 is in the open position the ventilation cap 410 is preferably in the closed position.

FIG. 5 also shows that one embodiment of the air flow control box 400 may comprise: vent blades 450, a spring 455, and a stopper 460. The vent blades 450 are preferably mounted across the ventilation opening 408 and are preferably movable. Additionally, each of the vent blades 450 are preferably positioned in a parallel manner with one another. This preferably allows the vent blades 450 to cover the ventilation opening 408 when the vent blades 450 are in the closed position. In one embodiment, the vent blades 450 are preferably interconnected with each other via a link 457. This allows the vent blades 450 to pivot together between into an open position and a closed position. Additionally, a spring 455 may be mounted near a proximal end of the ventilation opening 408 and may be coupled between a vent blade and damper housing. This may allow the spring 455 to bias the vent blades 450 into the closed position. Preferably, the vent blades 450 may open, when the vent blades 450 encounters air pressure resulting from redirected drawn air from the closed damper assembly 415 (and towards the ventilation opening 408). The air flow control box 400 may also comprise a stopper, which may be positioned behind the ventilation opening 408 to prevent the vent blades 450 from blowing open.

Figure 6:
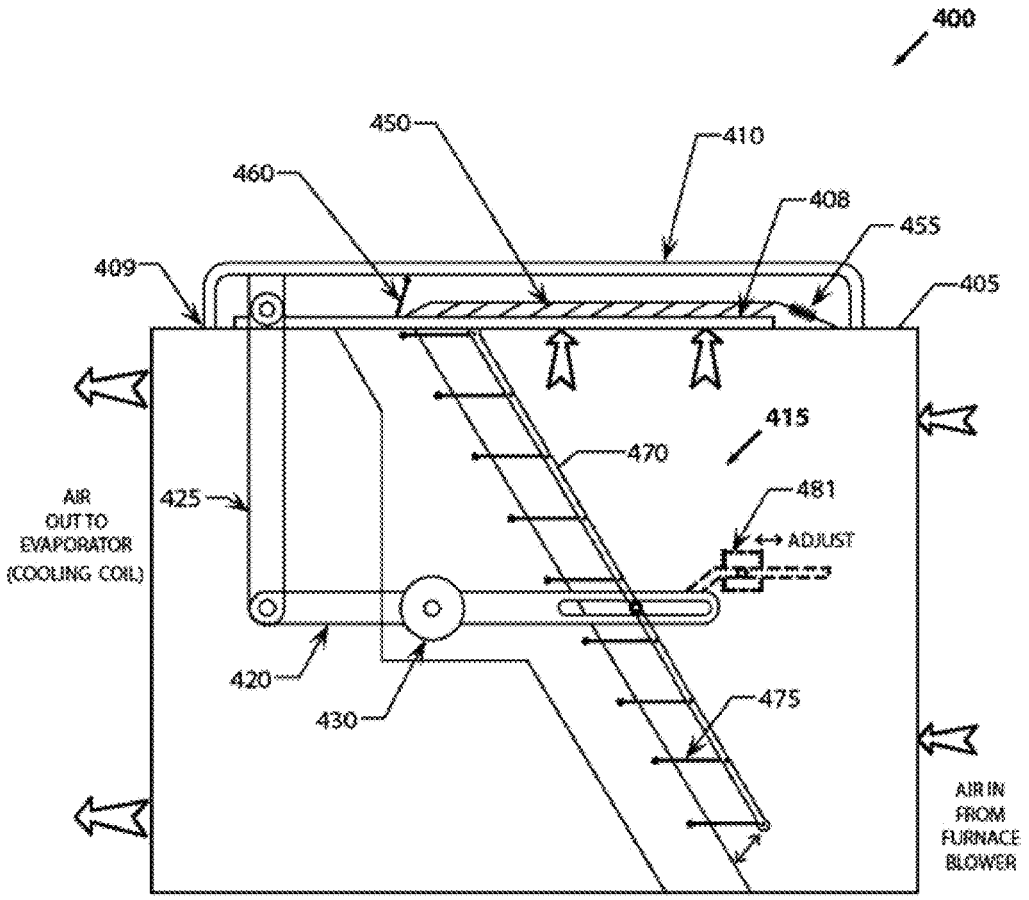
FIG. 6 is an illustration of a cross-section side view of one embodiment of the air flow control box and shows the ventilation cap and vent blades in the closed position.

FIG. 6 is an illustration of a cross-section side view of one embodiment of the air flow control box and shows the ventilation cap and vent blades in the closed position. As shown in FIG. 6, one embodiment of the air flow control box 400 may comprise: a damper housing 405, ventilation cap 410, damper assembly 415, control arms (e.g., first control arm 420, second control arm 425, damper motor 430, ventilation blades 450, spring 455, and stopper 460. FIG. 6 also shows that the damper assembly 415 may also comprise a link 470 and damper blades 475. Importantly, FIG. 6 shows that when the ventilation cap 410 is in the closed position, the damper blades 475 are preferably in the open position.

FIG. 6 also shows how the control arms may be coupled to one another. As discussed, above, in one embodiment, the damper blades 475 of the damper assembly 415 may be pivotally coupled to the link 470. The link 470 may be movably coupled to the proximal end of the first control arm 420, and the damper motor 430 may be movably coupled near the center portion of the first control arm 420. Additionally, the ventilation cap 410 may be coupled to an upper end of the second control arm 425 via a hinge 409, and the lower end of the second control arm 425 may be coupled to the distal end of the first control arm 420. This may also allow the damper motor 430, when actuated, to articulate the damper blades 475 and the ventilation cap 410 between the open and closed positions. The air flow control box 400 may then redirect the air drawn from the furnace to either the attic 240 or the cooling coil 225. In an alternate embodiment, the ventilation cap 410 and ventilation blades 450 may be replaced with damper blades or some other type of valve.

FIG. 6 also shows that, in one embodiment, the air flow control box 400 may further comprise a counterweight 481. The counterweight 481 is preferably a counterbalancing weight that balances a load. Specifically, the counterweight 481 preferably counterbalances the proximal end of the first control arm 420, such that the damper blades 475 of the damper assembly 415 are usually in the closed position. In another embodiment, the counterweight is preferably slideably positioned at the proximal end of the first control arm 420. This preferably allows the load created by the counterweight 481 to be adjustable. Although FIG. 6 shows that the air flow control box 400 comprises a counterweight 481, the air flow control box 400 may also lack a counterweight.

Figure 7:
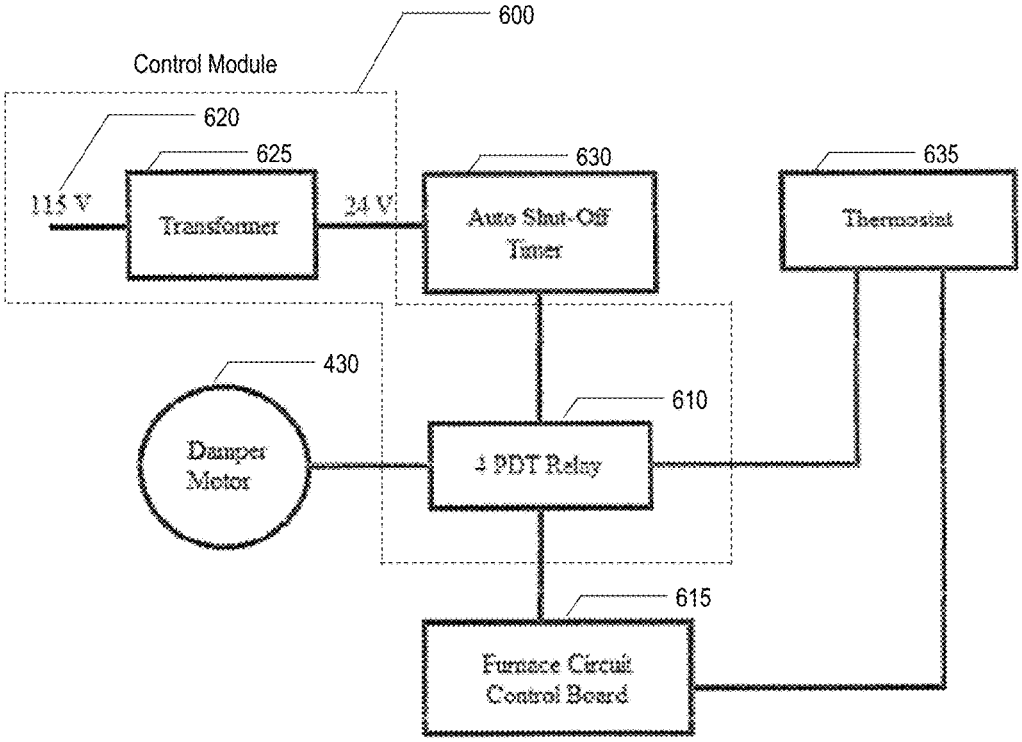
FIG. 7 is a block diagram of one embodiment of a control module and shows how the control module may be interconnected with a building structure's central air conditioning and heating system.

FIG. 7 is a block diagram of one embodiment of a control module and shows how the control module may be interconnected with a building structure's central air conditioning and heating system. As shown in FIG. 7, one embodiment of the control module 600 may comprise: a relay 610 and transformer 625. As discussed above, the control module 600 is preferably any hardware or software implementation that controls the actuation of the air flow control box 400 for selective movement of the ventilation cap 410 and damper blades 475. The control module 600 may be electrically coupled to building structure's central air conditioning and heating system and may be housed within the air flow control box 400. Specifically, depending on the control logic of the shutoff timer 630 and thermostat 635 of the building structure's central air conditioning and heating system, the control module 600 preferably actuates the damper motor 430 to: (1) switch the ventilation cap 410 in the open position and damper blades 475 into the closed position; or (2) switch the ventilation cap 410 into the closed position and the damper blades 475 into the open position.

FIG. 7 also shows that one embodiment of the control module 600 may comprise: transformer 625 and a relay 610, which may be a double pole double throw (DPDT) relay that is electrically coupled among a power source 620 via the transformer 625, a furnace control board 615, auto shut-off timer 630, the damper motor 430, and a thermostat 635. The relay 610 is preferably an electrical device, typically incorporating an electromagnet that is activated by one or more electrical currents or signals from the furnace control board 615, auto shut-off timer 630, and/or a thermostat 635. This preferably allows the thermostat 635 and the furnace control board 615 to selectively enable power delivery from the power source 620 to the damper motor 430. The power source 620 may be any power supply that supplies electric energy to the control module 600 and air flow control box 400. In one embodiment, the power source 620 may be a standard 115 volt power supply, which is the standard voltage supply in most homes or dwellings.

FIG. 7 also shows that the control module 600 may comprise a transformer 625. The transformer 625 is preferably a component or device for reducing or increasing the voltage of the power source 620. The transformer 625 may be electrically coupled between the power source 620 and the auto shut-off timer 630, such that the transformer 625 may increase or reduce the input voltage of the auto shut-off timer 630.

Regarding the auto shut-off timer 630, the auto shut-off timer 630 is preferably an object or timing device that automatically shuts off the air ventilation system 200. The auto shut-off timer 630 may be electrically coupled between the relay 610 and the power source 620 and is preferably configured to enable power delivery from the power source 620 to the relay 610 and to the damper motor 430. Although FIG. 7 shows the auto shut-off timer 630 as a separate device or component of the control module 600, the auto shut-off timer 630 may be a component integral to or part of an existing central air conditioning and heating system.

FIG. 7 also shows the operation of the control module 600. In one embodiment, as shown in FIG. 7, the transformer 625 may reduce the supply voltage of the power source 620 from 115V to 24V. The 24V may supply the input voltage for the control module 600, including the auto shut-off timer 630 and/or thermostat 635. Depending on the control logic of the shutoff timer 630, thermostat 635, and/or furnace control board 615, the relay 610 may transfer the supply voltage to the damper motor 430. In this embodiment, the user preferably configures the thermostat 635 and auto shut-off timer 630 at the desired settings in order to actuate the damper motor 430 of the air flow control box 400 to redirect furnace air to the attic 240 rather than the cooling coil 225. In particular, the user may configure the auto shut-off timer 630 at the desired time when the thermostat 635 is in the "fan-on" configuration and the "heat/cool-off" configuration. This preferably allows the output control signals of the auto shut-off timer 630, thermostat 635, and/or furnace control board 615 to activate the relay 610 to allow electrical current to flow and activate the damper motor 430. In this configuration, the damper motor 430 may actuate the damper blades 470 into the closed position and the ventilation cap 410 in the open position. In this manner, the furnace air may then be redirected into the attic 240 rather than the cooling coil 225. Once the desired time of the auto shut-off timer 630 has been reached, the auto shut-off timer 630 may send a control signal to deactivate the switching of the relay 610, which may cause the damper motor 430 to actuate the damper blades 470 into the open position and the ventilation cap 410 into the closed position. As a result, the furnace air may then be redirected to the cooling coil 225 rather than the attic 240. The furnace air accumulated in the attic 240 may be released into the atmosphere via the attic vent(s) 245. In order to shut off the air ventilation system 200, the user may configure the thermostat from the "fan-on" position to the "fan-auto" position. This will preferably cause the auto shut-off timer 630 to turn off automatically.

Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

The foregoing description of the preferred embodiment has been presented for the purposes of illustration and description. While multiple embodiments are disclosed, still other embodiments will become apparent to those skilled in the art from the above detailed description. These embodiments are capable of modifications in various obvious aspects, all without departing from the spirit and scope of protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that the scope of protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. An air ventilation system, comprising:

an air flow control box;

a control module; and a ventilation cap;

wherein said air flow control box comprises: a damper housing; a damper assembly; a first control arm; a second control arm; and a damper motor;

wherein said damper housing comprises: a first opening, a second opening, and a ventilation opening;

wherein said damper housing defines a passage traversing from a proximal end to a distal end of said damper housing and comprises a ventilation opening;

wherein said first opening is at said proximal end of said damper housing;

wherein said second opening is at said distal end of said damper housing;

wherein said damper assembly has a closed damper position and an open damper position;

wherein said ventilation opening is closable, such that said ventilation opening has an open ventilation position and a closed ventilation position;

wherein when said damper assembly is in said closed damper position said ventilation opening is in said open ventilation position;

wherein when said damper assembly is in said open damper position said ventilation opening is in said closed ventilation position;

wherein said damper assembly blocks said passage when in said closed damper position, such that an air entering said first opening is directed out of said ventilation opening;

wherein said damper assembly allows said air to pass through said passage when in said open damper position, such that said air entering said first opening is directed out of said second opening and not out of said ventilation opening;

wherein said ventilation cap is positioned over said ventilation opening and is hingedly connected to said damper housing for a selective ventilation cap movement between an open cap position and a closed cap position, such that, when said ventilation cap is in said closed cap position, said ventilation opening is covered, and when said ventilation cap is in said open cap position, at least a portion of said ventilation opening is uncovered;

wherein said damper assembly comprises a plurality of damper blades;

wherein said plurality of damper blades are disposed substantially in parallel with and adjacent to one another;

wherein each of said plurality of damper blades are interconnected with one another via at least one first link and is pivotally mounted across a respective portion of said damper assembly, such that each of said plurality of damper blades is configured to pivot together for a selective damper blades movement between said closed damper position and said open damper position to selectively allow said air to flow from said proximal end to said distal end of said damper housing;

wherein said first and second control arms are coupled among said damper motor, said ventilation cap, and said at least one first link, such that said damper motor simultaneously actuates said selective movements of said ventilation cap and said plurality of damper blades between said open positions and said closed positions; and wherein said control module is configured to actuate said damper motor.

2. The air ventilation system of claim 1, wherein said damper housing is positioned between a furnace and a cooling coil, such that said proximal end of said damper housing is adjacent to said furnace and said distal end of said damper housing is adjacent to said cooling coil.

3. The air ventilation system according to claim 1, wherein said control module comprises:

a relay;

wherein said relay is electrically coupled and is operatively interposed among a power source, a furnace control board, said damper motor, and a thermostat, such that said thermostat and said control board are adapted to selectively enable a power delivery from said power source to said damper motor;

wherein said control module further comprises: an auto shut-off timer electrically coupled and operatively interposed between said relay and said power source, such that said auto shut-off timer is also adapted to selectively enable power delivery from said power source to said damper motor.

4. The air ventilation system according to claim 3, wherein said air flow control box further comprises:

a counterweight;

a plurality of vent blades; and at least one spring;

wherein said counterweight is positioned at a proximal end of said first control arm;

wherein said plurality of vent blades are pivotally mounted across said ventilation opening, each of said plurality of vent blades is disposed substantially in parallel with and adjacent to each another;

wherein each of said plurality of vent blades is interconnected with each other via at least one second link, such that said plurality of vent blades pivot together for selective movement between an open vent blade position and a closed vent blade position;

wherein said at least one spring is located at a proximal end of said damper housing and is coupled between one of said plurality of vent blades and said damper housing, such that said at least one spring is adapted to bias said one or more vent blades into said closed vent blade position; and wherein said plurality of vent blades are adapted to be in said open vent blade position when said plurality of vent blades encounter an air pressure above a predetermined level;

wherein said air pressure results from said air flowing against said damper assembly when said damper assembly is in said closed vent blade position.

5. An air ventilation system, comprising:

an air flow control box; and a control module;

wherein said air flow control box comprises: a damper housing; a ventilation cap; a damper assembly; a first control arm; a second control arm; and a damper motor;

wherein said damper housing defines a passage traversing from a proximal end to a distal end of said damper housing;

wherein an upper portion of said damper housing comprises a ventilation opening;

wherein said ventilation cap is positioned over said ventilation opening and is hingedly connected to said upper portion of said damper housing for selective movement between an open ventilation cap position and a closed ventilation cap position, such that, when said ventilation cap is in said closed ventilation cap position, said ventilation opening is covered, and when said ventilation cap is in said open ventilation cap position, at least a portion of said ventilation opening is exposed;

wherein said damper assembly is in covering relation with said passage with a top portion of said damper assembly being positioned at least behind a distal end of said ventilation opening of said damper housing;

wherein said damper assembly comprises a plurality of damper blades, each of said plurality damper blades disposed substantially in parallel with and adjacent to one another;

wherein each of said plurality of damper blades are interconnected with each other via at least one first link and is pivotally mounted across a respective portion of said damper assembly, such that each of said plurality of damper blades are configured to pivot together for selective movement between an open damper blade position and a closed damper blade position to selectively allow an air to flow from said proximal end to said distal end of said damper housing;

wherein said damper motor is coupled at a center portion of said first control arm and wherein a proximal end of said first control arm is movably coupled to said at least one first link, such that, when said damper motor is actuated, said first control arm articulates said at least one first link for selective movement of said plurality of damper blades between said open position and said closed position;

wherein said second control arm is vertically disposed within an opening located at said upper portion of said damper housing, such that a lower portion of said second control arm is substantially within said damper housing;

wherein a bottom end of said second control arm is hingedly coupled to a distal end of said first control arm and wherein an upper end of said second control arm is hingedly coupled to said ventilation cap, such that, when said damper motor is actuated, said second control arm vertically moves said ventilation cap between said open ventilation cap position and said closed ventilation cap position; and wherein when said damper motor actuates said damper assembly in said closed damper blades position, said ventilation cap is in said open ventilation cap position, and when said damper motor actuates said damper assembly is in said open damper blades position, said ventilation cap is in said closed ventilation cap position, such that said ventilation cap and said damper assembly are articulated simultaneously by said damper motor;

wherein said control module is configured to actuate said damper motor of said air flow control box for said selective movement of said ventilation cap and said plurality of damper blades between said open damper blades position and said closed damper blades position.

6. The air ventilation system according to claim 5, wherein said control module comprises:

a double pole double throw (DPDT) relay;

wherein said DPDT relay is electrically coupled and is operatively interposed among a power source, a furnace control board, said damper motor, and a thermostat, such that said thermostat and said control board are adapted to selectively enable power delivery from said power source to said damper motor.

7. The air ventilation system according to claim 6, wherein said control module further comprises:

an auto shut-off timer electrically coupled and operatively interposed between said DPDT relay and said power source, such that said auto shut-off timer is also adapted to selectively enable power delivery from said power source to said damper motor.

8. The air ventilation system according to claim 7, wherein said control module further comprises a transformer electrically coupled between said power source and said auto shut-off timer.

9. The air ventilation system according to claim 8, wherein said air flow control box further comprises:

a counterweight;

wherein said counterweight is slideably connected at a proximal end of said first control arm, such that a load created by said counterweight is adjustable.

10. The air ventilation system according to claim 9, wherein said air flow control box further comprises:

a plurality of vent blades;

at least one spring; and a stopper;

wherein said plurality of vent blades are pivotally mounted across said ventilation opening, each of said plurality of vent blades are disposed substantially in parallel with and adjacent to one another;

wherein each of said plurality of vent blades are interconnected with each other via at least one second link, such that said plurality of vent blades pivot together for selective movement between an open vent blade position and a closed vent blade position;

wherein said at least one spring positioned at a proximal end of said damper housing and is coupled between one of said plurality of vent blades and said upper portion of said damper housing, such that said at least one spring is adapted to bias said one or more vent blades into said closed vent blade position;

wherein said plurality of vent blades are adapted to be in said open vent blade position, when said plurality of vent blades encounters an air pressure above a predetermined level;

wherein said air pressure results from said air flowing against said damper assembly when said damper assembly is in said closed damper blades position; and wherein said stopper is positioned substantially at a distal end of said ventilation opening and is adapted to prevent said plurality of vent blades from blowing open.

11. The air ventilation system according to claim 8, wherein said air flow control box further comprises:

a counterweight;

wherein said counterweight is slideably connected at a proximal end of said first control arm, such that a load created by said counterweight is adjustable;

wherein said air flow control box further comprises:

a plurality of vent blades;

at least one spring; and a stopper;

wherein said plurality of vent blades are pivotally mounted across said ventilation opening, each of said plurality of vent blades are disposed substantially in parallel with and adjacent to each another;

wherein said plurality of vent blades are interconnected with each other via at least one second link, such that said plurality of vent blades pivot together for selective movement between an open vent blade position and a closed vent blade position;

wherein said at least one spring located at a proximal end of said damper housing and is coupled between one of said plurality of vent blades and said upper portion of said damper housing, such that said at least one spring is adapted to bias said one or more vent blades into said closed vent blade position;

wherein said plurality of vent blades is adapted to be in said open vent blade position, when said plurality of vent blades encounters an air pressure above a predetermined level;

wherein said air pressure results from said air flowing against said damper assembly when said damper assembly is in said closed damper blade position; and wherein said stopper is positioned at a distal end of said ventilation opening and is adapted to prevent said plurality of vent blades from blowing open.

12. An air ventilation system selectively directing furnace air to an attic, comprising:

an air flow control box; and a control module;

wherein said air flow control box comprises: a damper housing; a ventilation cap; a damper assembly; a first control arm; a second control arm; and a damper motor;

wherein said damper housing defines a passage traversing from a proximal end to a distal end of said damper housing;

wherein said proximal end of said damper housing is adapted to couple to a furnace;

wherein said distal end of said damper housing is adapted to couple to a cooling coil;

wherein an upper portion of said damper housing comprises a ventilation opening;

wherein said ventilation cap is positioned over said ventilation opening and hingedly connected to said upper portion of said damper housing for selective movement between an open ventilation cap position and a closed ventilation cap position, such that, when said ventilation cap is in said closed position, said ventilation opening is covered, and when said ventilation cap is in said open ventilation cap position, at least a portion of said ventilation opening is exposed;

wherein said damper assembly is in covering relation with said passage and is angularly disposed with respect to a longitudinal axis of said passage based on a length of said ventilation opening, such that a top end portion of said damper assembly, is positioned below a distal end of said ventilation opening and a bottom end portion of said damper assembly is positioned below a proximal end of said ventilation opening;

wherein said damper assembly comprises a plurality of damper blades, each of said plurality of damper blades disposed substantially in parallel with and adjacent to one another;

wherein each of said plurality of damper blades are interconnected with each other via at least one first link and is pivotally mounted across a respective portion of said damper assembly; such that each of said plurality of damper blades are configured to pivot together for selective movement between an open position damper blade position and a closed damper blade position to selectively allow an air to flow from said proximal end to said distal end of said damper housing;

wherein said damper motor is disposed at a side of said damper housing;

wherein said damper motor is coupled at a center portion of said first control arm and wherein a proximal end of said first control arm is movably coupled to said at least one first link, such that, when said damper motor is actuated, said first control arm articulates said at least one first link for selective movement of said plurality of damper blades between said open damper blade position and said closed damper blade position;

wherein said second control arm is vertically disposed within an opening located at said upper portion of said damper housing, such that a lower portion of said second control arm is substantially within said damper housing;

wherein a bottom end of said second control arm is hingedly coupled to a distal end of said first control arm and wherein an upper end of said second control arm is hingedly coupled to said ventilation cap, such that, when said damper motor is actuated, said second control arm vertically moves said ventilation cap between said open ventilation cap position and said closed ventilation cap position;

wherein when said damper motor actuates when said damper assembly in said closed damper blade position, said ventilation cap is in said open ventilation cap position, and when said damper motor actuates when said damper assembly is in said open damper blade position, said ventilation cap is in said closed ventilation cap position, such that said ventilation cap and said damper assembly are articulated simultaneously by said damper motor; and wherein said control module is configured to actuate said damper motor of said air flow control box for selective movement of said ventilation cap and said plurality of damper blades between said open positions and said closed positions, respectively.

13. The air ventilation system according to claim 12, wherein said control module comprises:

a double pole double throw (DPDT) relay; and an auto shut-off timer;

wherein said DPDT relay is electrically coupled and is operatively interposed among a power source, a control board, said damper motor, and a thermostat, such that said thermostat and said control board are adapted to selectively enable power delivery from said power source to said damper motor;

wherein said auto shut-off timer is electrically coupled and operatively interposed between said DPDT relay and said power source, such that said auto shut-off timer is also adapted to selectively enable power delivery from said power source to said damper motor.

* * * * *